US009259764B2

(12) United States Patent
Sukkar

(10) Patent No.: US 9,259,764 B2
(45) Date of Patent: Feb. 16, 2016

(54) APPARATUS AND METHOD FOR PROCESSING BAGGED REFUSE

(75) Inventor: Maysarah Sukkar, Beirut (LB)

(73) Assignee: Averda IP B.V., JB Amsterdam (NL)

( * ) Notice: Subject to any disclaimer, the term of this patent is extended or adjusted under 35 U.S.C. 154(b) by 39 days.

(21) Appl. No.: 13/825,776

(22) PCT Filed: Sep. 22, 2011

(86) PCT No.: PCT/EP2011/066495

§ 371 (c)(1),
(2), (4) Date: May 6, 2013

(87) PCT Pub. No.: WO2012/038502

PCT Pub. Date: Mar. 29, 2012

(65) Prior Publication Data

US 2013/0220893 A1 Aug. 29, 2013

(30) Foreign Application Priority Data

Sep. 22, 2010 (EP) ..... 10251632

(51) Int. Cl.
*B07B 7/01* (2006.01)
*B03B 9/06* (2006.01)
(Continued)

(52) U.S. Cl.
CPC ... *B07B 7/01* (2013.01); *B03B 9/06* (2013.01); *B07B 7/04* (2013.01); *B07B 9/02* (2013.01); *B65B 69/0008* (2013.01)

(58) Field of Classification Search
CPC ..... B07B 7/01; B07B 7/04; B07B 13/05; B29B 2017/0234; B65G 51/00; B65G 51/22; B65G 69/008; B65F 5/005; E04F 17/12
USPC ..... 209/3, 634, 643, 680, 906, 930; 406/184, 187, 188, 191, 195; 414/412; 83/27
See application file for complete search history.

(56) References Cited

U.S. PATENT DOCUMENTS 2,403,740 A * 7/1946 Muench ..... 65/506
3,145,858 A * 8/1964 Helbig ..... 414/412
(Continued)

FOREIGN PATENT DOCUMENTS

CA 2293865 A1 6/2001
DE 199 38 706 A1 2/2001
(Continued)

OTHER PUBLICATIONS

International Search Report of International Application No. PCT/EP2011/066495, dated May 23, 2012.
(Continued)

*Primary Examiner* — Joseph C Rodriguez
(74) *Attorney, Agent, or Firm* — Fay Sharpe LLP

(57) ABSTRACT

A method of processing bagged refuse includes pneumatically conveying filled refuse bags along a conduit using an airflow and opening the bags during the pneumatic conveyance. An apparatus for carrying out the method includes a conduit configured to pass an airflow to pneumatically convey bagged refuse along the conduit and a bag opening structure arranged to open the refuse bags during pneumatic conveyance along the conduit. The open bagged refuse is sorted into fractions using the airflow by passing the refuse across an opening through which the airflow continues. A wall is arranged in the path of travel of the pneumatically conveyed refuse to disaggregate the refuse by impacting the refuse against the wall. The wall is arranged vertically and at least partially defines an opening through which the air stream continues such that a fraction of the refuse falling across the opening is conveyed through the opening.

20 Claims, 6 Drawing Sheets

Figure 1:
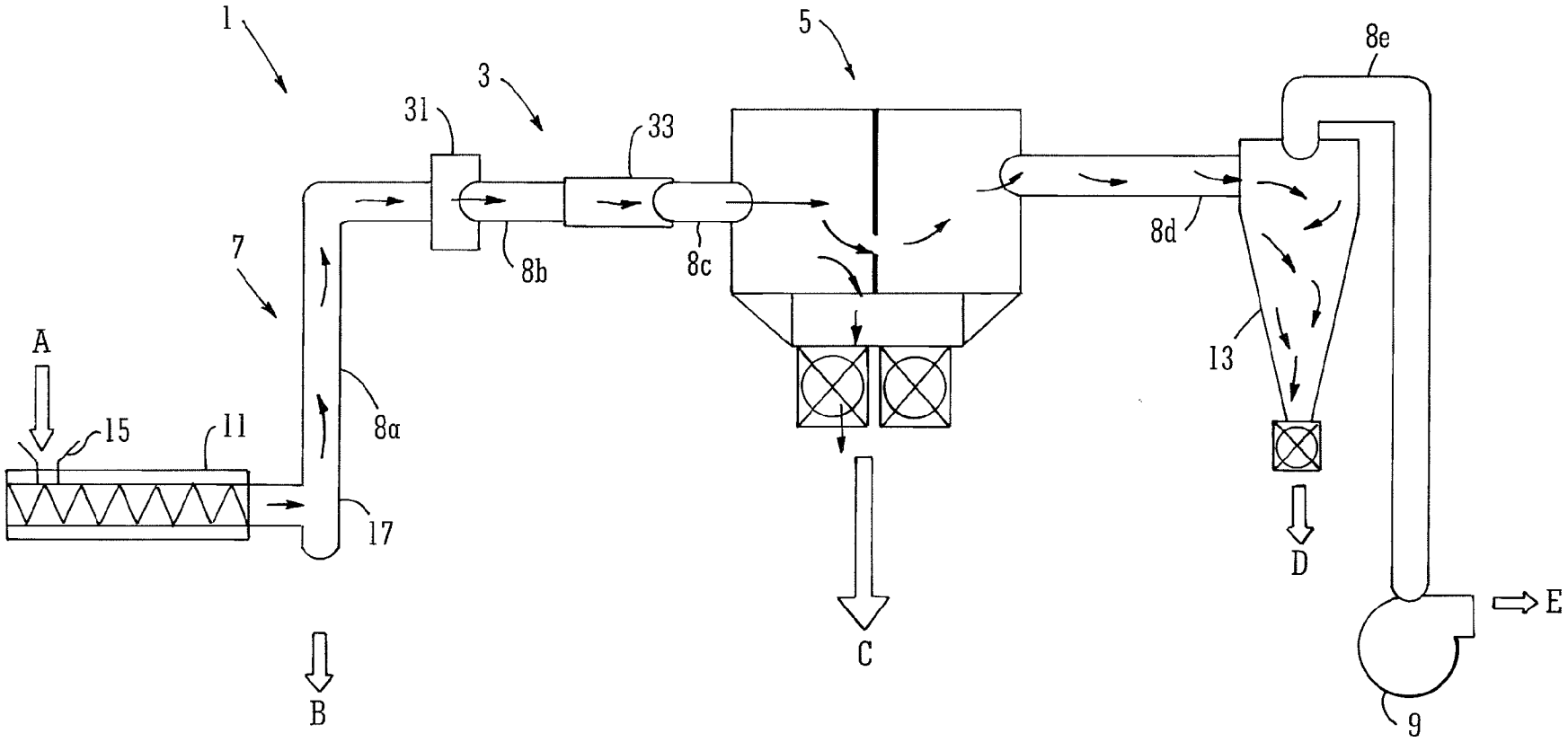

(51) Int. Cl.

| | |
|---|---|
| ***B07B 7/04*** | (2006.01) |
| ***B07B 9/02*** | (2006.01) |
| *B65B 69/00* | (2006.01) |

(56) References Cited

U.S. PATENT DOCUMENTS

| | | | | | |
|---|---|---|---|---|---|
| 3,163,472 | A | * | 12/1964 | Zeismer | 406/171 |
| 3,848,813 | A | | 11/1974 | Stanczyk et al. | |
| 3,853,355 | A | * | 12/1974 | Buisson | 406/19 |
| 4,240,769 | A | | 12/1980 | Diaz | |
| 4,252,489 | A | | 2/1981 | Mechalas | |
| 4,394,256 | A | | 7/1983 | Goff | |
| 4,418,871 | A | | 12/1983 | Powell | |
| 4,423,987 | A | * | 1/1984 | Powers | 406/56 |
| 4,479,581 | A | | 10/1984 | Kelyman, Jr. | |
| 4,515,509 | A | * | 5/1985 | Frisz | 414/412 |
| 4,995,770 | A | * | 2/1991 | Crane | 414/412 |
| 5,083,704 | A | * | 1/1992 | Rounthwaite | 232/43.2 |
| 5,484,247 | A | * | 1/1996 | Clark et al. | 414/412 |
| 5,567,106 | A | * | 10/1996 | Gassner | 414/412 |
| 5,622,471 | A | * | 4/1997 | Sommer et al. | 414/810 |
| 5,813,192 | A | * | 9/1998 | White | 53/381.2 |
| 5,934,576 | A | * | 8/1999 | Robinette | 241/15 |
| 6,077,021 | A | * | 6/2000 | Roman | 414/412 |
| 6,322,295 | B1 | * | 11/2001 | Gabriele | 406/84 |
| 6,338,829 | B1 | * | 1/2002 | Kodama et al. | 422/261 |
| 6,955,265 | B2 | | 10/2005 | Tse | |
| 2011/0013994 | A1 | * | 1/2011 | Sundholm | 406/154 |
| 2013/0243536 | A9 | * | 9/2013 | Arrabal et al. | 406/117 |

FOREIGN PATENT DOCUMENTS

| | | | |
|---|---|---|---|
| FR | 2 373 336 | A1 | 7/1978 |
| JP | 07-013836 | U | 3/1995 |
| JP | 08-215638 | | 8/1996 |
| JP | 11-347530 | A | 12/1999 |
| JP | 110347530 | | 12/1999 |
| JP | 2001-078744 | A | 3/2001 |
| KR | 10-2007-0081466 | A | 8/2007 |

OTHER PUBLICATIONS

Written Opinion of the International Searching Authority of International Application No. PCT/EP2011/066495, dated May 23, 2012.

International Preliminary Report on Patentability of International Application No. PCT/EP2011/066495, dated Mar. 26, 2013.

* cited by examiner

APPARATUS AND METHOD FOR PROCESSING BAGGED REFUSE

The present invention relates to apparatus and methods for processing refuse, including bagged refuse, by which bagged refuse can be opened and refuse can be sorted into fractions for further processing (such as incineration or recycling).

Refuse, such as waste collected from domestic and commercial premises, for example, by a refuse truck, is typically provided aggregated together in tied or sealed bags made of thin plastic. Each bag may contain different types of waste, such as paper items, plastic items, and metal items, mixed in together.

Certain types of waste may have residual commercial value through recycling or burning for energy creation. In addition, environment pressures provide a desire to reduce the amount of waste that is sent to landfill or incinerated unnecessarily. Therefore, collected refuse is often processed to sort the different types of waste for appropriate further processing.

While in many cases certain steps of the refuse processing (for example, the sorting of loose refuse) are performed manually, it is often advantageous for certain steps to be performed automatically to scale the waste processing and increase efficiency without increasing labour costs.

Various systems of apparatus are known for performing, at least in part automatically, the refuse processing described above. For example, U.S. Pat. No. 3,848,813 discloses a system of apparatus for refuse processing that is fairly typical of the that known in the art.

In U.S. Pat. No. 3,848,813, collected refuse, including bagged refuse, is passed through a shredder, which, in this case, is a double opposed flail mill. Rotating drum shredders are also used in the art. The shredder tears open bagged refuse and reduces the refuse to a fairly coarse shredded refuse product.

This shredded refuse is then conveyed, using rotating conveyor belts, through various separation and sorting steps. Various types of refuse separator are known in the art, which may separate refuse on the basis of one or more of their weight, size, ferromagnetic qualities. U.S. Pat. No. 3,848,813 discloses various types of known separator, some of which use air flows.

In one type of separator known from U.S. Pat. No. 3,848,813, a vertical air stream is used to suck up relatively light shredded refuse into a hood as it travels along a conveyor. A cyclone connected to the hood via a conduit then separates the refuse from the air stream, which is then exhausted. A blower, such as a centrifugal fan, is connected to the cyclone to provide the air flow. In another known type described in U.S. Pat. No. 3,848,813, shredded refuse is dropped through a horizontally travelling air stream and is thereby sorted into various fractions.

However, the shredding of refuse in this way can greatly increase the difficulty of the sorting and recycling of the refuse.

As a result, apparatus for breaking open refuse bags without shredding their contents is also known in the art to be used in place of shredders. Rotating drum-based bag openers are known, and bag openers based on a series of blades opposing a conveyor carrying unopened refuse bags are also known, for example from Japanese patent application nos. JP-A-11347530 and JP-A-08215638, and from U.S. Pat. No. US 4,479,581. Another design, based on a rotating inclined drum for conveying bagged refuse and having blades and pins arranged on its inner surface to open the bags and a series of meshed screens to grade and sort the refuse, is known from United States patent no. U.S. Pat. No. 6,955,265.

However, these bag opening apparatuses are unreliable. For example, the drum and opposed blade bag breakers known in the art attempt to open multiple bags at the same time and often fail to open all the bags. Also, these bag breakers can have a limiting effect on the throughput of the refuse sorting process due to the speed of the mechanical conveyance of the refuse to, from and through the bag breaker, and the speed of operation of the bag breakers themselves. In addition, these known bag breakers have a high running cost and are subject to repeated mechanical failure.

It is therefore an object of the present invention to provide an apparatus and method for processing refuse, including bagged refuse, which is reliable and can achieve a high throughput.

Pneumatic conveyance of refuse, including bagged refuse, is known in the art only for providing point-to-point transfer of the refuse, for example, for a refuse drop-off point in a building to a refuse container for temporarily storing the refuse.

Viewed from a first aspect, the present invention provides a method of processing bagged refuse comprising: pneumatically conveying filled refuse bags along a conduit using an airflow; and opening the bags during pneumatic conveyance along the conduit.

In accordance with this aspect of the invention, refuse bags are pneumatically conveyed along a conduit and can be quickly and reliably opened to liberate their contents for sorting without the need to shred the bags and their contents. During pneumatic conveyance, the refuse bags are generally driven one after the other along the conduit and so the bag opening operation is reliably performed by each bag being attacked and opened individually. Thus all of the refuse can be liberated from the bags to be available for sorting. By using an airflow to drive the refuse bags through a bag opening process, a static bag opening means can be used meaning that relatively few mechanical moving parts are needed and no mechanically driven parts of the bag opening means are needed. Therefore, power consumption in the bag opening method can be low and reliability of the apparatus can be high. In addition, as can be seen below, the same airflow that drives the refuse bags through the bag opening process can also be used in later stages of the refuse processing. Thus a single source of energy (e.g. a single suction source) can be provided to drive multiple stages of refuse processing. In addition, the use of pneumatic conveyance to drive a bag opening process in this way allows a high throughput of opened bags to be achieved. For example, the bags typically may be driven through the bag opening process by an airflow travelling above 40 $ms^{-1}$, and a high throughput from the refuse processing is achievable. Further, the use of pneumatic conveyance through this and other stages of the refuse processing allows for easy construction and installation of the refuse processing system. For example, the conduits for pneumatic conveyance can be designed and installed to go around existing apparatus in a facility, whereas conveyor-based refuse processing systems require large amounts of space and are unwieldy.

The bag opening step may be performed by at least one projecting member arranged to project into the path of travel of the bagged refuse during pneumatic conveyance. Preferably, the or each projecting member projects inwardly from the wall of the conduit into the path of travel of the refuse. Projecting members may be arranged around the inside of the conduit to surround the path of travel of the refuse. Projecting members may be provided in sets adjacent to each other, or longitudinally spaced from each other along the length of the pneumatic conveyance conduit. Preferably, the projecting members are provided with retraction means configured to retract the projecting members when the pressure differential across them is above a certain level or when the force exerted on the projecting members by the refuse is above a certain level. Preferably, scraping means are provided configured to achieve the scraping of debris off the projecting members. Preferably the scraping means is provided as scraping seals around the projecting members which remove debris when the projecting members are retracted. The at least one projecting member is preferably provided as one or more knives and/or one or more pins. If both knives and pins are provided, the knives are preferably arranged in the path of travel before the pins, but they may be provided alongside the pins or after the pins. These preferred arrangements can achieve reliable and effective opening of refuse bags.

The refuse processing method may further comprise disaggregating the opened bagged refuse before sorting the refuse by impacting the refuse against a wall arranged in the path of travel of the refuse using the airflow. In this optional method, after the refuse bags are opened, the opened bagged refuse may still be loosely aggregated together, which may limit the ease with which the refuse can be sorted. By impacting the refuse against a wall arranged in the path of travel of the refuse using the airflow, the bagged refuse can be effectively disaggregated and thereafter reliably sorted. In addition, the same airflow that drove the bagged refuse through the bag opening process, for example at typical speeds of 50 $ms^{-1}$, can be easily used to impact the refuse against a wall in the path of travel of the refuse, thereby effectively disaggregating it.

The refuse processing method may further comprise sorting the opened bagged refuse into fractions using the airflow. By using the same airflow to pneumatically drive refuse through a bag opening step and a refuse sorting step, an effective and reliable sorting of refuse can be achieve having a high throughput (up to at least 20 tonnes/hour may be achievable) and only a single source of energy may be needed to drive the bag opening and a refuse sorting step, which increases the reliability of the system and gives a low power consumption. In addition, this preferred arrangement provides a simple and elegant refuse processing method in which unsorted, bagged refuse is input into a pneumatic system which outputs the refuse in loose, sorted form.

The sorting of the opened bagged refuse may be performed by passing the refuse across an opening through which the airflow continues. The impacting and sorting of the opened bagged refuse may be performed by driving the refuse against the wall and allowing the refuse to fall across an opening at least partly defined by the wall, wherein a fraction of the refuse is conveyed through the opening by the continuing airflow, and the remaining refuse falls out of the airflow. This arrangement provides a simple but effective method of reliably sorting refuse into different fractions by means of an airflow which can be used to convey the refuse through the sorting process. The characteristics of the fractions of refuse separated in this way depend on a variety of factors including those of the airflow passing through the opening. For example, the refuse may be separated into a first fraction comprising generally planar items and a second fraction comprising generally non-planar items. Examples of planar items include plastic film and paper-based items, including loose paper, newspapers, magazines, etc. For example, the size of the opening may affect the separation of fractions of the refuse. The size of the opening may be changeable to adjust the sorting process and the characteristics of the separated fractions. The refuse that drops out of the airflow may be removed from the sorting process using one or more rotary valves. Multiple sorting steps may be used to separate the refuse into more than two fractions. The sorting steps may be performed sequentially using the same airflow, or in parallel, using the different airflows. The different airflows may be provided by the same or different sources of airflow (e.g. centrifugal fans). Any material left in the airflow at the end of the sorting steps may be removed from the airflow using a cyclone.

In addition, in this preferred arrangement, a single airflow is used to convey the refuse to be sorted and to separate out a relatively light fraction of the refuse which continues along with the air flow.

Viewed from a second aspect, the present invention provides apparatus for processing bagged refuse, comprising: a conduit configured to pass an airflow to pneumatically convey bagged refuse along the conduit; and bag opening means arranged to open the refuse bags during pneumatic conveyance along the conduit. The apparatus preferably further comprises a blower arranged to, in use, create an airflow in the conduit to pneumatically convey bagged refuse along the conduit. The bag opening means may comprise at least one projecting member, for example, one or more knives and/or one or more pins, which projects into the path of travel of the bagged refuse during pneumatic conveyance. The apparatus may further comprise a wall arranged in the path of travel of the pneumatically conveyed bagged refuse downstream of the bag opening means to disaggregate the opened refuse bags in use by the bagged refuse impacting against the wall, the wall being arranged vertically and at least partly defining an opening through which the airflow continues in use such that a fraction of the refuse falling across the opening is conveyed through the opening and the remaining refuse falls out of the airflow.

The above-mentioned advantages of the method of the first aspect of the invention result equally from the apparatus of the second aspect of the invention.

Viewed from a third aspect, the present invention provides a method of sorting refuse comprising: pneumatically conveying refuse in a conduit using an airflow; and sorting the refuse into fractions using the airflow by passing the refuse across an opening through which the airflow continues along with a fraction of the refuse.

In accordance with this aspect, there is provided a simple but effective method of reliably sorting refuse into fractions by means of an airflow which can be used to convey the refuse through the sorting process. In addition, a single airflow is used to convey the refuse to be sorted and to separate out a fraction of the refuse which continues along with the air flow. Further, the pneumatic conveyance of the refuse provides an elegant sorting system in which collected refuse can be provided as an input to a pneumatic conveyance system at one end and sorted refuse can be output at the other end. In addition, the same energy source can be used to drive the conveyance and sorting of the refuse, providing a system with a low number of moving mechanical parts, and enabling low operating costs and providing a system that is simple and easy to maintain. For example, where a centrifugal fan is used as the source of the airflow, only the fan may need to be driven and maintained.

The method may further comprise disaggregating the pneumatically conveyed refuse before sorting the refuse by impacting the refuse against a wall arranged in the path of travel of the refuse using the airflow. The sorting of the refuse may be performed by, after impacting the refuse against the wall, allowing the refuse to fall across an opening at least partly defined by the wall, wherein a fraction of the refuse is conveyed through the opening by the continuing airflow, and the remaining refuse falls out of the airflow.

The opening may be defined in the wall of the conduit.

Viewed from a fourth aspect, the present invention provides apparatus for sorting refuse, comprising: a conduit configured to pass an airflow to pneumatically convey refuse along the conduit; and a wall arranged in the path of travel of the pneumatically conveyed refuse to disaggregate the refuse in use by impacting the refuse against the wall, the wall being arranged vertically and at least partly defining an opening through which the airflow continues in use such that a fraction of the refuse falling across the opening is conveyed through the opening.

Viewed from a fifth aspect, the present invention provides a method of processing refuse, comprising: pneumatically conveying refuse along a conduit using an airflow; and disaggregating the pneumatically conveyed refuse by impacting the refuse against a wall arranged in the path of travel of the refuse using the airflow.

In accordance with this aspect of the invention, collected refuse that may be clumped together, or may be provided in opened bags, can be disaggregated in a simple yet effective way to facilitate sorting and further processing of the refuse.

Figure 2A:
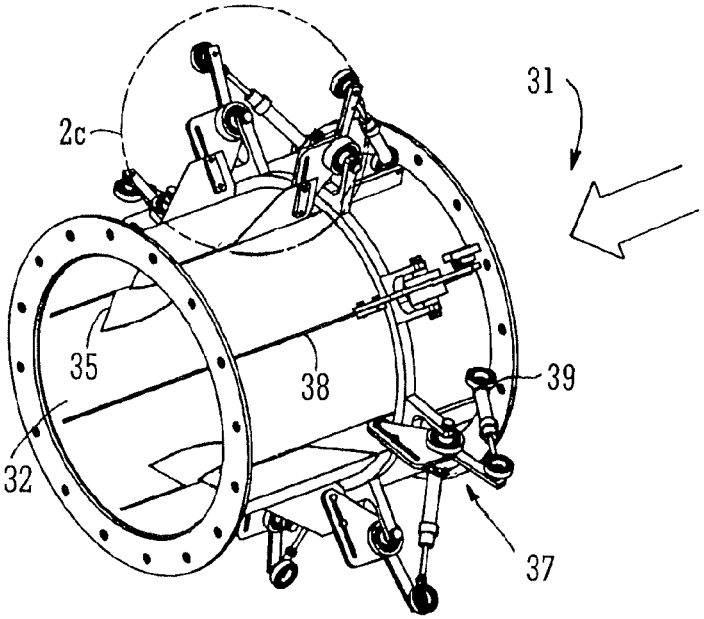
Figure 2B:
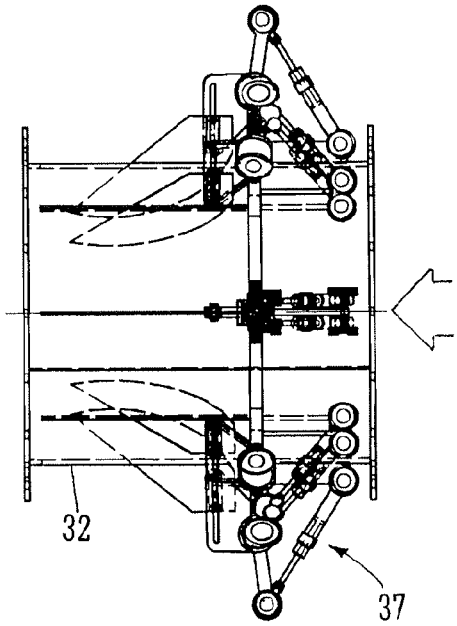
Figure 2C:
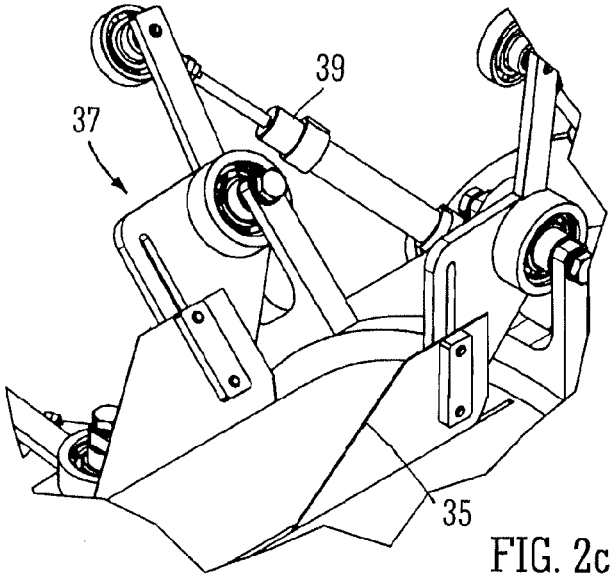

Certain preferred embodiments of the invention will now be described with reference to the accompanying drawings in which:

FIG. 1 is a schematic view of a system of apparatus for sorting bagged refuse in accordance with an embodiment of aspects of the present invention;

FIGS. 2*a*-2*e* show views of the knife set provided in the embodiment shown in FIG. 1;

FIG. 2*a* is a perspective view of the knife set;

FIG. 2*b* is a side view of the knife set;

FIG. 2*c* is an enlarged view of the portion labeled 2*c* in FIG. 2*a;*

Figure 2D:
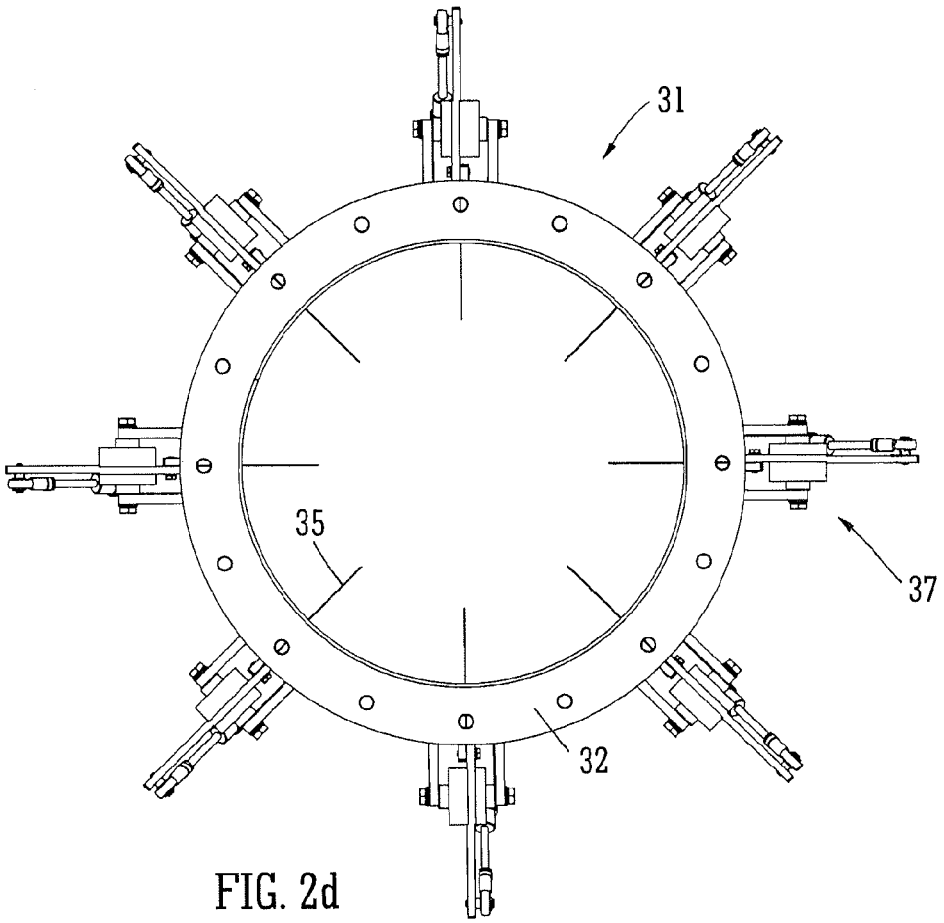
Figure 2D:
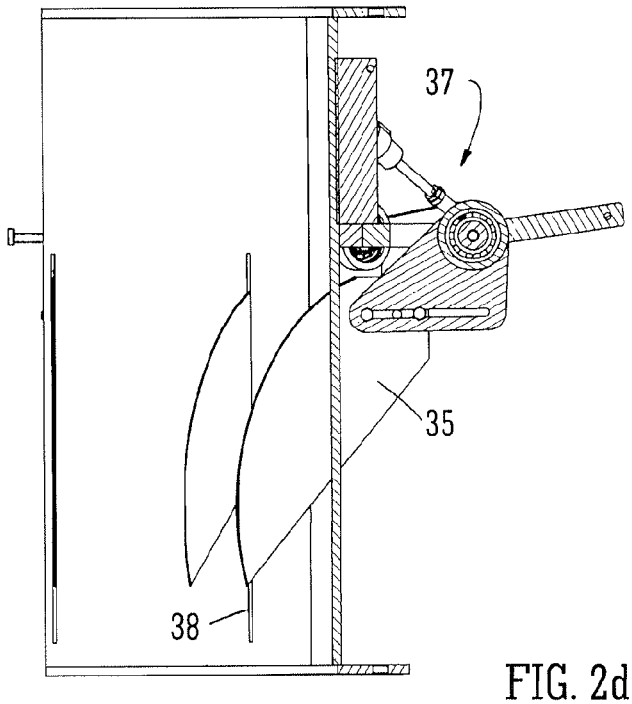
Figure 2E:
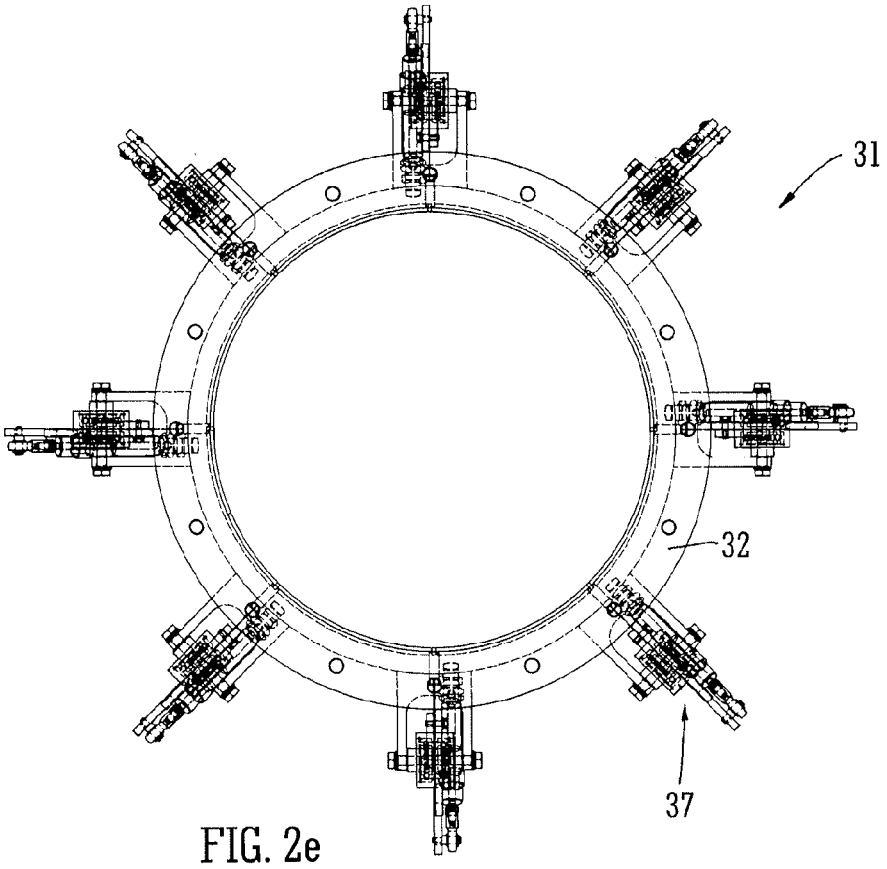
Figure 2E:
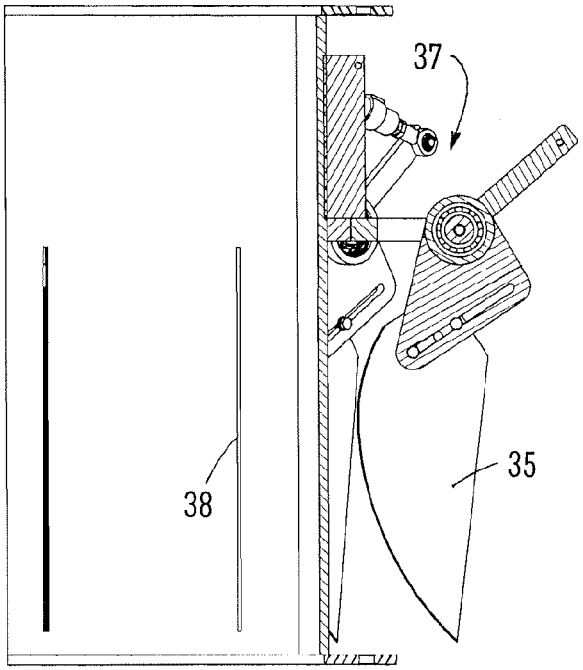
Figure 3A:
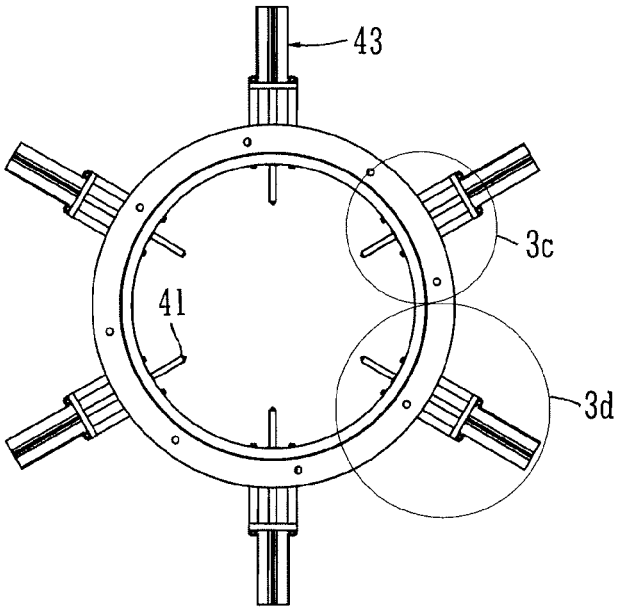
Figure 3B:
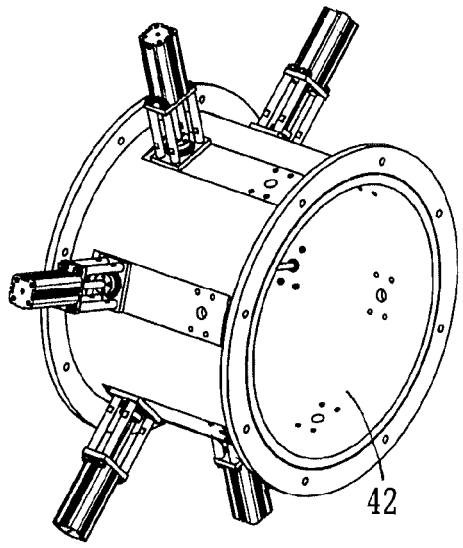
Figure 3C:
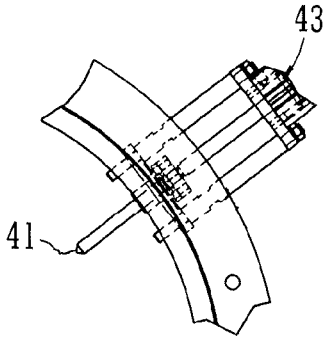

FIG. 2*d* is an end view of the knife set with the blades in their protruding positions;

FIG. 2*d'* is a partial longitudinal cross-section through the knife set with the blades in their protruding positions;

FIG. 2*e* is an end view of the knife set with the blades in their retracted positions;

FIG. 2*e'* is a partial longitudinal cross-section through the knife set with the blades in their retracted positions;

FIG. 3*a*-3*d* show views of the pin set provided in the embodiment shown in FIG. 1;

FIG. 3*a* is an end view of the pin set with the pins in their protruding positions;

FIG. 3*b* is a perspective view of the pin set;

FIG. 3*c* is an enlarged view of the portion labeled 3*c* in FIG. 3*a;*

Figure 3D:
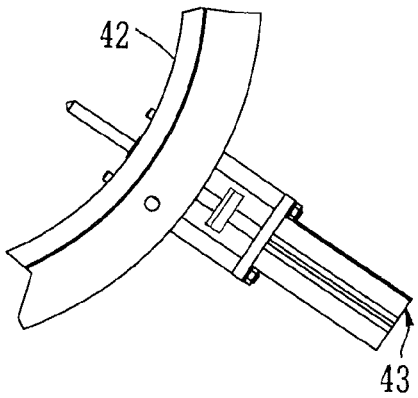

FIG. 3*d* is an enlarged view of the portion labeled 3*d* in FIG. 3*a;*

Figure 4B:
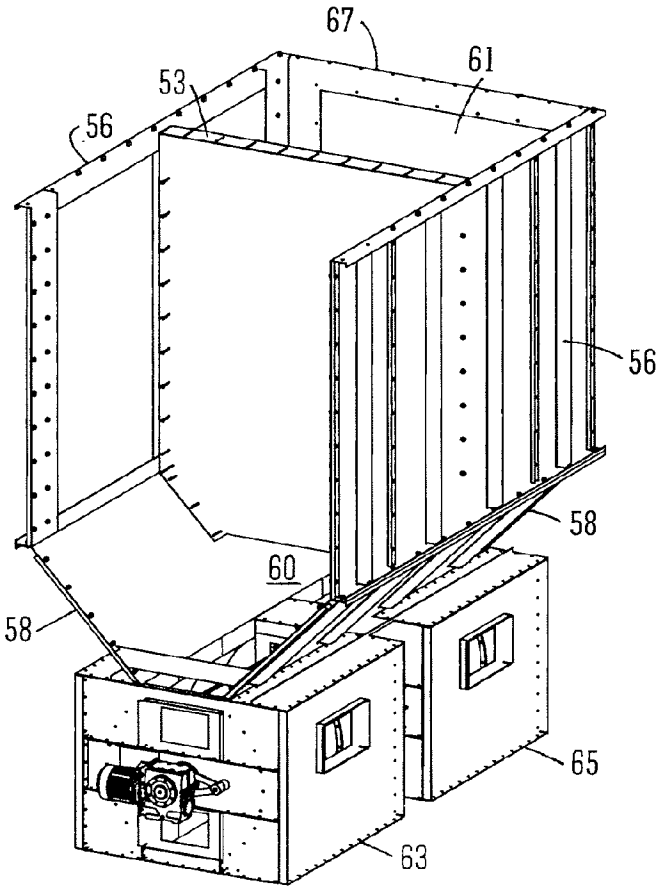
Figure 4A:
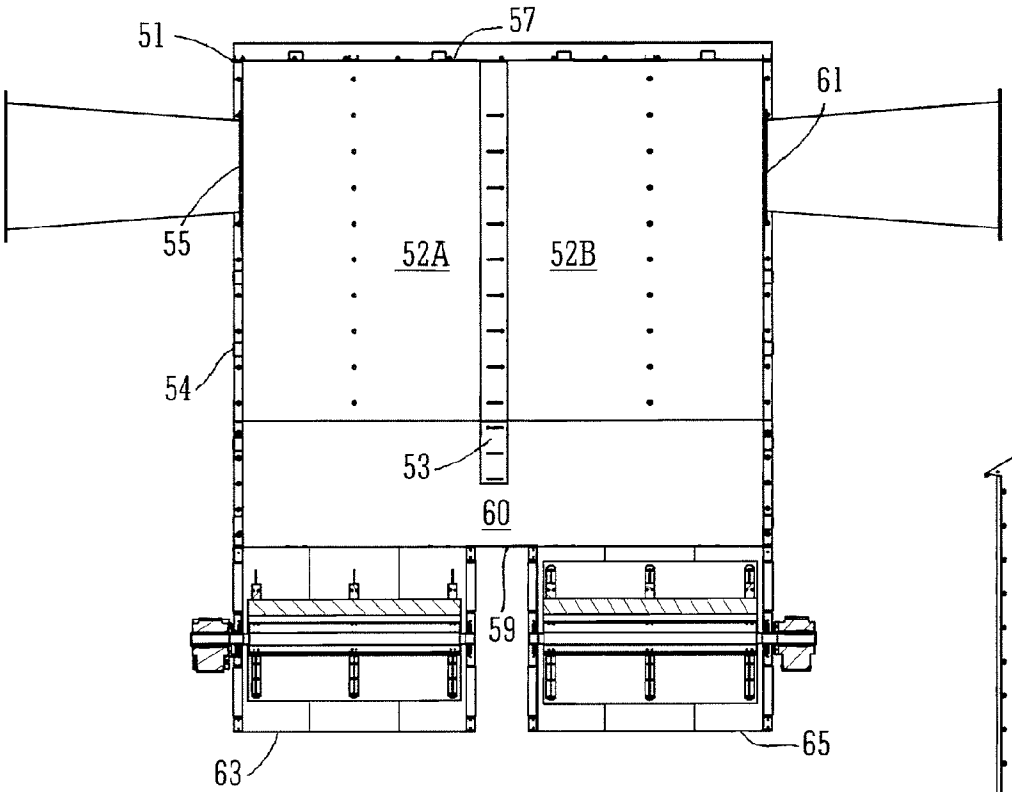

FIGS. 4*a* and 4*b* show views of the sorting chamber provided in the embodiment shown in FIG. 1;

FIG. 4*a* is a cross section through the sorting means viewed from one side; and FIG. 4*b* is a perspective view, partially cutaway, of the sorting means.

FIG. 1 shows a schematic of a system of apparatus 1 for processing refuse, including bagged refuse, in accordance with aspects of the present invention. Bag opening means 3 and sorting means 5 are connected in-line, as part of a conduit 7 sized to receive and pass filled standard refuse bags having an 80 liter to 100 liter capacity. The conduit 7 is provided at least in part by sections of pipe 8*a*, 8*b*, 8*c*, 8*d*, 8*e* having a nominal diameter of 500 mm. The pipe 8*a*, 8*b*, 8*c*, 8*d*, 8*e* may be made of any suitable material, such as steel, aluminum or extruded plastics. A centrifugal fan 9 is provided at one end of the conduit, connected to pipe section 8*e* and the fan 9 and pipe sections are arranged to provide a suitable airflow and pressure to entrain refuse input into the conduit 7 by a screw conveyor 11 and to drive the refuse through the bag opening means 3 and sorting means 5. In the embodiment, the fan 9 has backward inclined blades and is of power 160 kW, capable of delivering an airflow of 40,000 cubic metres per hour and a pressure of 5 inches of mercury (17 kPa). A cyclone 13 is provided to separate out a fraction of refuse entrained in the airflow in pipe section 8*d*.

Operation of the refuse processing apparatus 1 will now be described. Refuse, including bagged refuse, collected from a variety of sources, such as domestic and commercial waste, is input into the apparatus 1 by depositing it in a hopper 15, as indicated by the input A in FIG. 1. The screw conveyor 11 is of the shaftless screw type and is operated to remove refuse from the outlet at the base of the hopper 15 and convey it to the conduit 7, where refuse bags are inserted into the conduit 7 by the conveyor 11 one by one. The conduit 7 begins as a section of pipe 8*a* provided as a T-section at the outlet of the screw conveyor 11 to function as a gravity chute 17. Here, the pipe 8*a* is vertically arranged, opening at its lower end into a container (not shown) for receiving heavy items. Operation of the fan 9 creates an airflow in the conduit having an air speed of 45-50 $ms^{-1}$ in the pipe section 8*a*, with the air being input into the conduit 7 at the open lower end of the pipe 8*a*. The screw conveyor 11 inserts bagged refuse into the airflow at a distance along the pipe 8*a*. Heavy items of refuse which cannot be entrained by the airflow due to their characteristics (such as size, shape, weight, density and/or drag) fall out of the pipe 8*a* at its open end into the container, as indicated by the output B in FIG. 1.

Refuse that can be entrained by the airflow continues up and along the pipe 8*a* as indicated by the arrows in FIG. 1. The apparatus 1 is arranged such that, by the time the refuse reaches the bag opening means 3, the refuse bags will have reached a desired speed due to the air flow which is sufficient for the refuse bags to be reliably opened by the bag opening means 3.

The structure and operation of the bag opening means 3 will now be described in more detail with reference to FIGS. 2-3.

The bag opening means comprises a knife set 31 (shown in FIG. 2) and a pin set 33 (shown in FIG. 3). The knife set 31 and pin set 33 are provided as sections of pipe having a nominal diameter equal to pipe sections 8*a*, 8*b* and 8*c*.

As shown in FIG. 2, in the knife set 31, a series of blades 35 is arranged spaced around the wall of the pipe 32 to protrude inwardly therefrom into the path of travel of bagged refuse along the conduit, as shown in FIGS. 2*a*, 2*b* and 2*d*. The blades 35 are arranged to point obliquely away from the input direction of the refuse bags, so as to reduce the slowing of the bags as they travel past the blades 35. As the refuse bags travel past the knife set 31 due to the airflow, the bag itself comes up against one or more of the blades which causes the bags to be slit open. Alternatively, the points of the blades may be directed towards the input direction of travel of the bagged refuse. More than one such radial array of blades 35 may be provided in the knife set, spaced along the length of the pipe 32.

The blades 35 are each provided with retraction means 37 (shown in detail in FIG. 2*c*) arranged outside the pipe 32 by which the blades 35, which extend through slots 38 provided in the pipe wall, are retracted from the pipe 32 if the force acting on the blade 35 (e.g. due to the pressure across the knife set from a blockage) is above a certain level by action of the retraction means 37 against an air cylinder 39. After the bag has passed, the retraction means 37 returns the blade 35 to its original, operational position. Scraper seals, arranged in slots 38, are provided to scrape the blades 35 as they are retracted in order to remove any debris that may have become stuck to the blades 35 in use. To maintain the knife set 31, scraping of the blades 35 can be periodically initiated by operating the air cylinder 39 of each retraction means 37. The operation of the retraction means 37 is illustrated in FIGS. 2*d* and 2*e*, which show, respectively, the blades 35 in their protruding and retracted positions.

After the bags have been slit open by the knife set 31, the bags are conveyed on through the pipe section 8*b* to the pin set 33, where the airflow speed is again around 45-50 $ms^{-1}$.

As shown in FIG. 3, the pin set 33 is of a similar arrangement to the knife set 31, but in this case a series of 14 mm diameter steel pins 41 is arranged spaced around the wall of the pipe 42 to protrude inwardly therefrom 50 mm into the path of travel of bagged refuse along the conduit, as shown in FIGS. 3*a*, 3*b* and 3*c*. The pins 41 catch the slashed bags as they are conveyed through the pipe 42 and act pull the bags apart, thereby liberating their contents. In the embodiment, only one series of pins 41 is provided in the pipe 42, but more than one series of pins 41 could be provided. Multiple series of pins are preferably spaced 1.5 m apart.

Each pin 41 extends through a hole in the wall of the pipe 42 and is also provided with a retraction means 43 in the form of an air cylinder arranged outside the pipe 42 where it is attached to the end of the pin. Scraper seals are provided in the holes in the pipe 42 around the pins 41 where they extend through the pipe wall to scrape debris off the pins 41 as they are retracted. The retraction means 43 is configured to retract the pins by operation of the air cylinder. Again, if there is a blockage in the pipe 42, pressure may be relieved by retraction of the pins 41.

It has been found that an airflow speed in the pipe section 8*a* and the bag opening means 3 of at least 45-50 $ms^{-1}$ is desirable to ensure reliable bag opening. Increasing the airflow speed above this level can, however, achieve further improved bag opening results, albeit at the cost of greater power consumption.

After the fan 9 has driven the refuse through the pipe section 8*a* and the bag opening means 3 where the bags have been slashed open by the knife set 31 and pulled apart by the pin set 33, the refuse is pneumatically conveyed along a pipe section 8*c* in which the air speed is again around 45-50 $ms^{-1}$, and the refuse is accelerated for entry into a sorting means 5 in which the refuse is sorted into fractions.

The structure and operation of the sorting means 5 will now be described in more detail with reference to FIG. 4 of which FIG. 4*a* is a cross section through the sorting means viewed from one side, and FIG. 4*b* is a perspective view, partially cutaway.

The sorting means 5 comprises a steel sorting chamber 51 (see FIG. 4) having a wall 53 opposing an inlet 55 provided in a first end wall 54 of the chamber. The inlet 55 is connected to pipe 8*c* to receive the refuse into the chamber 51. The wall 53 is provided as a steel barrier dividing the sorting chamber into a first compartment 52A and a second compartment 52B. The inlet 55 enters the chamber 51 at its upper end and the wall 53 is arranged as a web, spanning the side walls 56 of the chamber and extending from the chamber ceiling 57 down to the lower end of the chamber 51. The chamber side walls 56 have inwardly slanted sections 58 at their lower end, which, together with a floor section 59 of the chamber 51, define an opening 60. At an upper end of the chamber 51 in second compartment 52B an outlet 61 is provided, which is connected to pipe section 8*d*.

The fan 9 provides, in use, an airflow through the chamber 51 which travels from the inlet 55, through the first compartment 52A, through the opening 60, through the second compartment 52B and through the outlet 61. Two rotary valves 63, 65 are provided at the base of the chamber 51, one in each of the first and second compartments 52A, 52B which maintain a seal at the bottom of the chamber 51, and ensure that the only available path for the airflow to follow is from the inlet 55 to the outlet 61.

The apparatus 1 and chamber 51 are arranged such that refuse entering the chamber 51 from the inlet 55 is travelling so fast that it strikes the wall 53 at a high speed (up to around 50 $ms^{-1}$). The inlet has a widening rectangular cross section so as to maximise the striking area on the wall 53. The striking of the refuse against the wall 53 in this way causes any items of refuse that are loosely clumped together, such as previously bagged refuse that has been opened by the bag opening means 3, to come apart from each other and become disaggregated. Opened bagged refuse can become completely emptied from the bags as a result of this impacting. This facilitates sorting of the items of refuse by the sorting means 5 because the airflow is enabled to act on each item of refuse individually.

The disaggregated refuse then falls through the first compartment 52A near the wall 53 and across the opening 60 whereupon a fraction of the items of refuse that can be entrained by the airflow at the opening will pass through the opening together with the airflow and be conveyed into the second compartment 52B. The remainder of the items of refuse that could not be entrained by the airflow at the opening 60 will remain in the first compartment 52A and fall into the rotary valve 63 which operates to pass them to a container underneath the chamber, as indicated by the arrow C in FIG. 1. The fraction of items of refuse that have passed through the opening 60 into the second compartment 52B and are entrained in the airflow are conveyed to the outlet 61 whereby they continue along the pipe section 8*d* to cyclone 13. Here the refuse is separated from the airflow and is output at the base of the cyclone into a container as indicated by the arrow D in FIG. 1. The airflow, sucked through the refuse processing apparatus 1, is output from the centrifugal fan 9 as clean air as indicated by the arrow E in FIG. 1.

The apparatus 1 and the opening 60 in the chamber 51 are arranged such that the airflow speed through the opening is around but not greater than 22 $ms^{-1}$. It has been found that this arrangement causes the fraction of refuse entrained in the airflow at the opening and conveyed to the second compartment 52B to comprise almost exclusively generally planar items or '2D' items, which are usually made up of readily recyclable, paper-based items such as plastic film, papers, newspapers, cardboard. These are output from the apparatus at the cyclone 13 at output D. The remainder of the items of refuse remaining in compartment 52A comprise generally non-planar items or '3D' items. These are output from the apparatus at rotary valve 63 at output C for further sorting or processing.

To help ensure that no unwanted items that pass through opening 60 travel to the outlet 61, the outlet 61 is arranged in the second end wall 67 near the upper end of the second compartment 52B. In this way, generally non-planar items that are conveyed through the opening 60 are likely to fall out of the airflow in the second compartment 52B and any such items are output from the chamber by rotary valve 65. The outlet 61 has a widened rectangular cross section to capture as much generally planar material entrained in the airflow as possible.

In accordance with the invention, refuse, including bagged refuse, can be input into the refuse processing system and be automatically separated out and sorted into fractions, such as generally planar and non-planar items, by being driven by a single airflow source. The operation of the bag opening means 3 and the sorting means 5 is such that it is the driving of the refuse by the fan 9 in the airflow through the bag opening means 3 and the sorting means 5 that enables them to perform their bag opening and sorting functions. In this way, the bag opening means 3 and the sorting means 5 could be considered to operate on the refuse 'passively' as part of a pneumatic refuse conveyance system.

The refuse processing apparatus provides a clean (i.e. all the refuse processing is contained in a closed conduit), efficient sorting system that can effectively handle bagged refuse that has a high throughput (up to at least 20 tonnes per hour) and is easy to maintain with a low number of moving mechanical parts.

In the embodiment, the size of the opening 60 is fixed. Alternatively, the chamber 51 may be configured such that the size of the opening may be changeable to adjust the sorting process and the characteristics of the separated fractions.

In the embodiment, the sorting means 5 only sorts the refuse into two fractions as generally planar or non-planar items. However, the same principles underlying the invention could be used to achieve separation of the refuse into a greater number of more finely graded fractions. For example, more than one chamber could be used or a series of openings could be provided in the chamber. Where multiple chambers are provided, these could be arranged in sequence along a single airflow, or in 'parallel' with the output of the rotary valve(s) of one chamber feeding into a separate airflow, which may be driven by a common fan or a separate fan.

In the embodiment, the bag opening means is provided by a set of knives and a set of pins. However, only knives or only pins could be used, or different types of projecting members arranged to extend into the path of travel of the refuse to open refuse bags could be used.

The invention claimed is:

1. A method of processing bagged refuse comprising:

pneumatically conveying filled refuse bags along a conduit using an airflow;

opening the bags during pneumatic conveyance along the conduit;

wherein the bag opening step is performed by at least one projecting member arranged to project into a path of travel of the bagged refuse during pneumatic conveyance;

wherein the at least one projecting member is arranged to retract when a pressure differential across it is above a certain level or when a force exerted on the at least one projecting member by the refuse is above a certain level; and wherein the at least one projecting member is provided with a scraper to scrape debris off the at least one projecting member when the at least one projecting member is retracted.

2. The method as claimed in claim 1, wherein the at least one projecting member is provided as one or more knives and/or one or more pins.

3. The method as claimed in claim 1, wherein the scraper comprises a scraping seal provided around the at least one projecting member which removes debris when the at least one projecting member is retracted.

4. The method as claimed in claim 1, further comprising disaggregating the opened bagged refuse by impacting the refuse against a wall arranged in the path of travel of the refuse using the airflow.

5. The method as claimed in claim 1, further comprising sorting the opened bagged refuse into fractions using the airflow, wherein the sorting of the opened bagged refuse is performed by passing the refuse across an opening through which the airflow continues along with a fraction of the refuse.

6. The method as claimed in claim 5, wherein a single source of energy is used to pneumatically drive refuse through the bag opening step and the refuse sorting step.

7. The method as claimed in claim 1, further comprising disaggregating the opened bagged refuse by impacting the refuse against a wall using the airflow and then sorting the opened bagged refuse into at least two fractions using the airflow;

wherein the impacting and the sorting of the opened bagged refuse is performed by driving the refuse against the wall and allowing the refuse to fall across an opening at least partly defined by the wall, wherein a fraction of the refuse is conveyed through the opening by the continuing airflow, and the remaining refuse falls out of the airflow.

8. The method as claimed in claim 7, wherein a single source of energy is used to pneumatically drive refuse through the bag opening step and the refuse sorting step.

9. Apparatus for processing bagged refuse, comprising:

a conduit configured to pass an airflow to pneumatically convey bagged refuse along the conduit;

bag opening means arranged to open the refuse bags during pneumatic conveyance along the conduit;

wherein the bag opening means comprises at least one projecting member which projects into a path of travel of the bagged refuse during pneumatic conveyance;

wherein the at least one projecting member is arranged to retract when a pressure differential across it is above a certain level or when a force exerted on the at least one projecting member by the refuse is above a certain level; and wherein the at least one projecting member is provided with a scraper to scrape debris off the at least one projecting member when the at least one projecting member is retracted.

10. The method as claimed in claim 1, wherein an air cylinder is arranged outside the conduit to return the at least one projecting member into the path of travel of the bagged refuse following retraction of the at least one projecting member.

11. The apparatus as claimed in claim 9, further comprising a wall arranged in the path of travel of the refuse so that the airflow causes the opened bagged refuse to impact against the wall to disaggregate it.

12. Apparatus The apparatus as claimed in claim 9, wherein the at least one projecting member is one or more knives and/or one or more pins.

13. The apparatus as claimed in claim 9, wherein the scraper comprises a scraping seal provided around the at least one projecting member which removes debris when the at least one projecting member is retracted.

14. The apparatus as claimed in claim 9, arranged so that in use the airflow causes the opened bagged refuse to be sorted into fractions, and comprising an opening through which, in use, the airflow continues along with a fraction of the refuse so that the refuse is sorted.

15. The apparatus as claimed in claim 14, wherein a single source of energy is configured to pneumatically drive refuse through the bag opening step and the refuse sorting step.

16. The apparatus as claimed in claim 15, wherein the single source of energy is a single suction source.

17. The apparatus as claimed in claim 9, further comprising a wall arranged in the path of travel of the pneumatically conveyed bagged refuse downstream of the bag opening means to disaggregate the opened refuse bags in use by the bagged refuse impacting against the wall, the wall being arranged vertically and at least partly defining an opening through which the airflow continues in use such that a fraction of the refuse falling across the opening is conveyed through the opening and the remaining refuse falls out of the airflow.

18. The apparatus as claimed in claim 17, wherein a single source of energy is configured to pneumatically drive refuse through the bag opening step and the refuse sorting step.

19. The apparatus as claimed in claim 18, wherein the single source of energy is a single suction source.

20. The apparatus as claimed in claim 9, comprising an air cylinder arranged outside the conduit which returns the at least one projecting member into the path of travel of the bagged refuse following retraction of the at least one projecting member.

* * * * *